US005542984A

United States Patent [19]

Krajicek

[11] Patent Number: 5,542,984

[45] Date of Patent: Aug. 6, 1996

[54] METHOD FOR DISPERSION OF SLUDGE AND FOR PREPARING A CIRCULATOR FOR DISPERSING SLUDGE

[75] Inventor: Richard W. Krajicek, Houston, Tex.

[73] Assignee: Serv-Tech, Inc., Houston, Tex.

[21] Appl. No.: 438,758

[22] Filed: May 10, 1995

Related U.S. Application Data

[62] Division of Ser. No. 261,438, Jun. 17, 1994, Pat. No. 5,460,331.

[51] Int. Cl.[6] ..... B08B 3/02; B08B 9/073

[52] U.S. Cl. ..... 134/22.1; 134/22.18; 134/24; 366/167.2; 29/402.04; 29/402.08; 29/888

[58] Field of Search ..... 134/22.1, 22.18, 134/24; 239/263.3, 263.1, 264; 366/156.1, 167.2, 168.1, 169.1; 29/888, 402.04, 402.08

[56] References Cited

U.S. PATENT DOCUMENTS

| | | | |
|---|---|---|---|
| 1,978,015 | 10/1934 | Erdman | 134/24 |
| 2,116,935 | 5/1938 | Richard et al. | 299/73 |
| 3,586,294 | 6/1971 | Strong | 366/163.2 |
| 3,834,625 | 9/1974 | Bathod-Malat | 239/227 |
| 3,878,857 | 4/1975 | Heibo | 134/167 |
| 3,953,226 | 4/1976 | Edmond et al. | 134/104 |
| 4,133,460 | 1/1979 | Jerpbak | 29/402.08 X |
| 4,190,940 | 3/1980 | Lawrence | 29/888 X |
| 4,407,678 | 10/1983 | Furness et al. | 134/167 |
| 4,682,725 | 7/1987 | Martin et al. | 29/402.08 X |
| 4,685,974 | 8/1987 | Furness et al. | 134/22.18 |
| 4,945,933 | 8/1990 | Krajicekt et al. | 134/167 |
| 5,037,486 | 8/1991 | Sloan | 134/24 X |
| 5,087,294 | 2/1992 | Rechtzigel | 134/22.1 |
| 5,091,016 | 2/1992 | Krajicek et al. | 134/22.1 |
| 5,351,885 | 10/1994 | Manabe | 239/73 |

*Primary Examiner*—Jill Warden
*Assistant Examiner*—Saeed Chaudhry
*Attorney, Agent, or Firm*—Jenkens & Gilchrist

[57] ABSTRACT

A method for cleaning the interior of storage tanks of the type used for storing large volumes of crude oil wherein hydrocarbon sludge accumulates with the passage of time. The method includes circulating the crude oil from the tank to a pump and then through the nozzle of a circulator having a gear member mounted to the periphery of a hollow rotor supporting the nozzle. A shaft driven worm gear in operative engagement with the gear member is positioned within a tube extending from the circulator, through an opening in a side of the tank that is closeable with a valve, to a position outside the storage tank. The worm gear, the gear member, the hollow rotor and the nozzle are rotated simultaneously with circulation of the crude oil through the nozzle of the circulator until the worm gear falls. The worm gear is then pulled through the tube to a position just past the valve, and the valve closed. The worm gear is then withdrawn from the tube, repaired or replaced, and reinserted into the tube to a position adjacent the closed valve. The valve is then opened, and the worm gear in inserted further into the tube until it engages the gear member, whereupon circulation of the crude oil simultaneously with rotation of the worm gear, gear member, hollow rotor and nozzle is resumed.

3 Claims, 5 Drawing Sheets

METHOD FOR DISPERSION OF SLUDGE AND FOR PREPARING A CIRCULATOR FOR DISPERSING SLUDGE

This application is a division of application Ser. No. 08/261,438, filed Jun. 17, 1994, now U.S. Pat. No. 5,460, 331.

BACKGROUND OF THE INVENTION

1. Field of the Invention

The present invention relates generally to an method for dispersing sediment, such as hydrocarbon sludge, in a storage tank, and more particularly to such a method that provides repair of the dispersion apparatus without emptying the storage tank.

2. Description of the Related Art

It is a common commercial practice to store liquid materials in storage tanks. Typically, for many industrial applications, storage tanks will have a diameter from 100 to 300 feet and heights of 20 to 50 feet or more. The liquids stored in such storage tanks are diverse. For example, water or aqueous solutions of organic or inorganic chemicals may be stored in this manner, derivatives of agricultural products such as vegetable oils which are water soluble are likewise stored in this manner.

More commonly, however, large volume storage tanks of this nature are used in the production, collection and refining of crude oils and derivatives thereof such as crude oils containing naphthenic and aromatic components, and refinery products such as gasolines, diesel fuels, jet fuels, fuel oils, kerosene, gas oil, etc., and petrochemical derivatives thereof such as benzene, xylene, toluene, etc.

With the passage of time, solid materials, usually in finely divided form, will accumulate in the storage tank and settle at the bottom thereof. When the accumulation becomes excessive, it must be removed from the storage tank.

One manner in which this can be accomplished is to drain the tank and then have workmen enter the tank and manually remove the sediments that are deposited therein. However, such a procedure is costly and time-consuming and can cause the workmen involved therein to be exposed to toxic or potentially toxic materials.

The problem of sediment accumulation is particularly accentuated insofar as the storage of crude oil and, in particular, aromatic and naphthenic crude oils is concerned. Such crude oils, as introduced into the storage tank, will normally contain aromatic, napthenic and asphaltic components which are believed to be potentially reactive and/or condensible with each other. Moreover, a minor amount of water will normally be present in the crude oil (e.g., about 0.1 to 5 wt. %). Usually, the water will not be present as a separate phase, but rather as small droplets of water emulsified by ionizable components of the crude oil, such as asphaltenes.

It is believed that molecular charge transfer forces, such as van der waals forces, cause many of the molecular aromatic, napthenic and asphaltic components of the crude oil to agglomerate and weakly bond to each other to form aggregates having a size sufficient to cause them to precipitate from the crude oil and to settle at the bottom of a crude oil storage tank together with the emulsified water droplets so that the resultant "hydrocarbon sludge" will normally comprise highly aromatic components such as polyaromatic components in which a significant portion of the water (in the form of emulsified droplets) will be occluded. Also, when phyrins are present, the porphyrin molecules are believed to be attracted to each other so as to form agglomerates that will settle from the crude oil stored in the crude oil storage tank. It is for reasons such as these that the sediment in the bottom of a crude oil storage tank is sometimes colloquially referred to as "black sediment and water" or "hydrocarbon sludge" or just plain "sludge".

The hydrocarbon sludge that accumulates, as such, is of marginal economic value and, if manually removed, usually represents a disposal problem.

Various prior art methods have been suggested for removing such materials from storage tanks. For example, U.S. Pat. No. 1,978,615 to Erdman is directed to method and apparatus for cleaning sediment from a tank containing a fluid comprising a central manifold from which a plurality of discharge pipes radiate, each discharge pipe being provided with a plurality of discharge nozzles so that liquid may be pumped through the central manifold and out through the nozzles to roil the sediment or other foreign materials at the bottom of the tank and suspend it for withdrawal through a side withdrawal pipe located above the apparatus.

U.S. Pat. No. 2,116,935 issued to Richard et al. is directed to a method and apparatus for cleaning tanks such as railroad tank cars and comprises a pipe which is suspended vertically in the tank for rotation about a horizontal axis and which contains, at a lower end thereof, a reaction nozzle mounted for rotation about a horizontal axis and includes a reaction nozzle member mounted on vertical conduit for rotation about a horizontal axis so that liquid pumped down the conduit is forced out the vertically disposed jets of the reaction nozzle. The device also includes appropriate means for slowly rotating the reaction nozzle about the vertical axis of the suspending pipe.

U.S. Pat. No. 3,586,294 to Strong is directed to a method and apparatus for creating a suspension of fine particles in a liquid in a tank using a plurality of spargers suspended above the bottom of the tank on a nonrotating lattice of feed pipes through which a liquid is pumped for emission through the sparging nozzles to suspend fine particles of sediment in the liquid for discharge from the tank on removal of the suspension.

U.S. Pat. No. 3,878,857 to Heibo is directed to a device for cleaning the side walls of a storage tank such as a tank located on a ship carrying crude oil. The apparatus comprises an L-shaped inlet pipe suspended from the top of the tank. A pair of diametrically opposed jets are mounted on the end of the "L" so that liquid pumped through the L-shaped inlet pipe will be forced to flow out of the pipe through one of the jets at a time. Means are provided for rotating the jetting means a fraction of a turn about a horizontal axis for each complete revolution about the vertical axis. The mechanism for accomplishing this is a worm gear which operates in conjunction with a cog wheel and a blocking wheel.

U.S. Pat. No. 3,953,226 to Edmond et al. is directed to a device for cleaning sediment from a tank and includes pipe means oscillatably suspended from the top of the tank. The oscillatable pipe means is provided, at a discharge point near the bottom of the tank, with one or more spray jets through which hot water may be sprayed to sweep suspended matter to a sump located on the opposite side of the storage tank for removal.

U.S. Pat. No. 4,407,678, issued to Furness et al., discloses a sludge removal machine for removing sludge from the bottom of a storage tank which comprises a hollow body, and laterally rotatable nozzles. The sludge removal machine is suspended in a storage tank from a pipe through which a cleaning liquid may be pumped. The sludge removal machine is also provided with a "turbine" or impeller for rotating the nozzles in order to disperse sludge. The rotational speed of the turbine, and thus the rotation rate of the nozzles, is determined by the viscosity, pressure, and flow rate of the liquid pumped through the machine. Therefore, if it is desired to increase or decrease the fairly critical speed of rotation of the nozzles, one of these parameters, e.g., flow rate must be adjusted accordingly.

U.S. Pat. No. 4,685,974, also to Furness et al., is directed to a method for removing settled sludge from the bottom of a storage tank which uses apparatus of the type disclosed and claimed in Furness et al. A liquid such as crude oil is pumped into a machine suspended in a storage tank adjacent a side wall thereof and which is provided with diametrically opposed lateral nozzles which are rotated in a manner such that each nozzle emits liquid during 180° of its rotation to avoid impingement of liquid on the side of the tank wall to thereby suspend the sludge in liquid in the tank, after which the liquid having sludge suspended therein is pumped from the tank.

In an improvement over the prior art, U.S. Pat. Nos. 4,945,933 and 5,019,016 disclose an apparatus useful for dispersing sediment contained in a crude oil storage tank. The apparatus generally comprises an oil circulator having a plurality of rotatably mounted nozzled outlet jets. Crude oil is continuously forced through the jets, whose rotation is controlled by an independently controllable indexing power means, to disperse the sediment.

While the prior art practices do provide methods for dispersing sludge in a crude oil storage tank, these methods require removal of the entire circulation apparatus from the tank which typically necessitates emptying of the tank before such removal can be accomplished. Therefore, there is a need for a method for dispersing sludge by rotating nozzles at a speed that is independently controllable of the fluid flow rate through the nozzles, and a method for easily removing the nozzle rotation drive train service or repair without emptying the storage tank or removing the entire fluid circulator.

SUMMARY OF THE INVENTION

The present invention is directed to a new and improved method for the removal of sediment, such as hydrocarbon sludge from a storage tank containing a liquid such as crude oil.

According to one embodiment of the present invention a method for redispersing hydrocarbon sludge deposited in a crude oil storage tank, having a opening in the side thereof covered by a closeable valve, includes circulating a liquid, such as crude oil either stored or to be stored in the tank, under high pressure to the interior of the tank through a liquid circulator disposed within the tank. The circulator has one or more nozzles that are rotated by a shaft driven worm gear positioned within a tubular casing extending through the tank wall opening. The worm gear engages a gear member disposed around the periphery of a hollow rotor which carries a nozzle support and the nozzles attached to the nozzle support. The high pressure delivery and rotation of the nozzles are continued until the shaft driven worm gear fails either due to stripping of the worm gear or shearing of a key which secures the worm gear to the driven shaft. At this point, the worm gear is disengaged from the gear member and pulled from the tubular casing to a point just past the valve. The valve is then closed, and the worm gear is completely withdrawn from the tubular casing and repaired and/or replaced. After repair or replacement, an operable shaft driven worm gear is inserted into the tubular casing to a position adjacent the valve. The valve is opened to allow passage of the shaft and worm gear which are then further inserted into the casing until the worm gear engages the gear member attached to the hollow rotor and is seated in an end cap thrust seat. The circulation and rotation steps above are then repeated.

In accordance with another embodiment of the present invention, a method for repairing the drive train of a crude oil circulator disposed in storage tank without draining the tank or removing the circulator includes disengaging a worm gear, operatively connected to the drive train, from a mating gear that is rotatably mounted in the circulor. The drive train with the attached worm gear is then withdrawn through an elongated tube extending from the circulator, through a closeable opening in the side of the storage tank, to a position outside the tank. The closeable opening has a valve that is closed after withdrawing the worm gear past the valve. The worm gear is then removed from the elongated tube, repaired or replaced, and then reinserted into the tube to a position adjacent the valve. The valve is then opened, and reinsertion of the drive train into the tube is continued until the worm gear engages the mating gear rotatably mounted in the circulator.

DETAILED DESCRIPTION OF THE INVENTION

Figure 1:
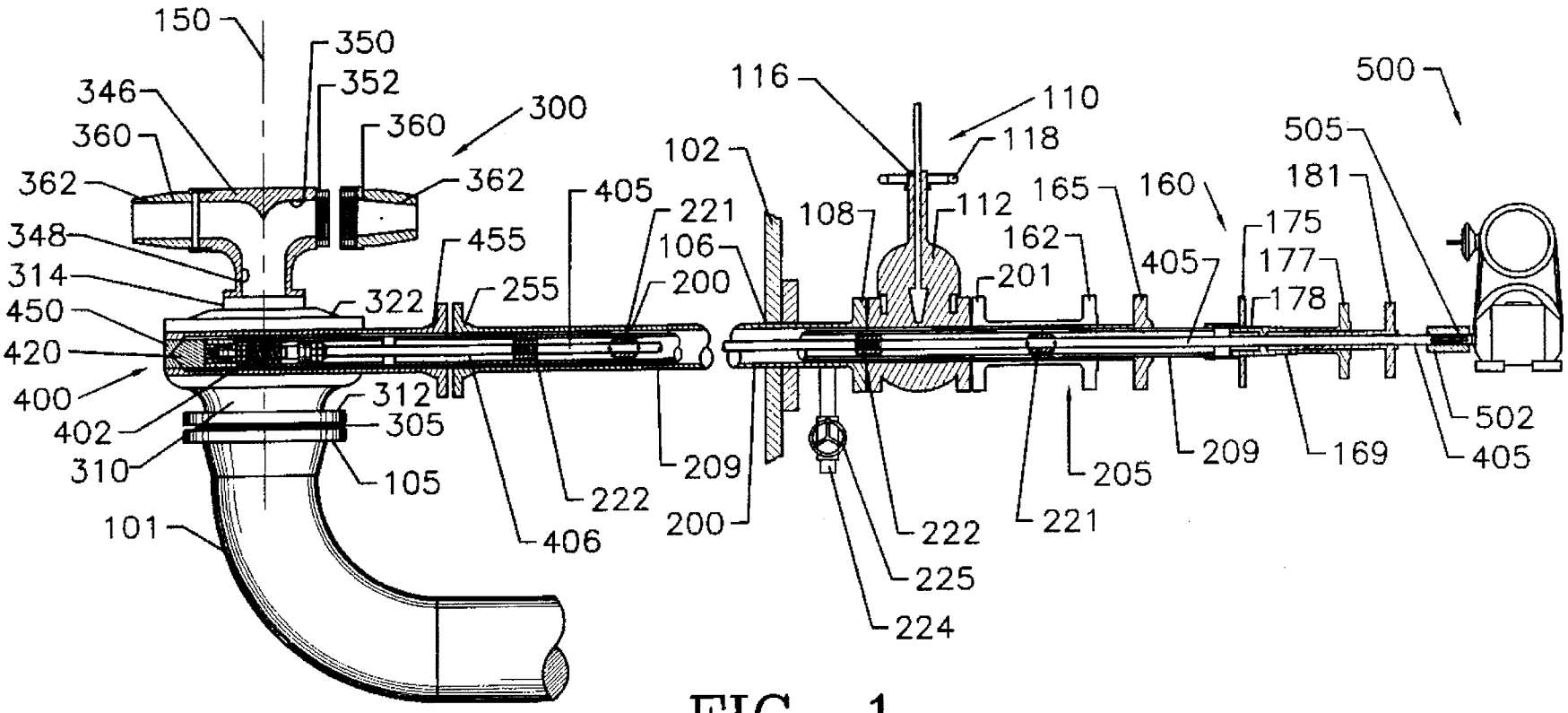
FIG. 1 is a side view of an apparatus for carrying out the method embodying the present invention.
Figure 2:
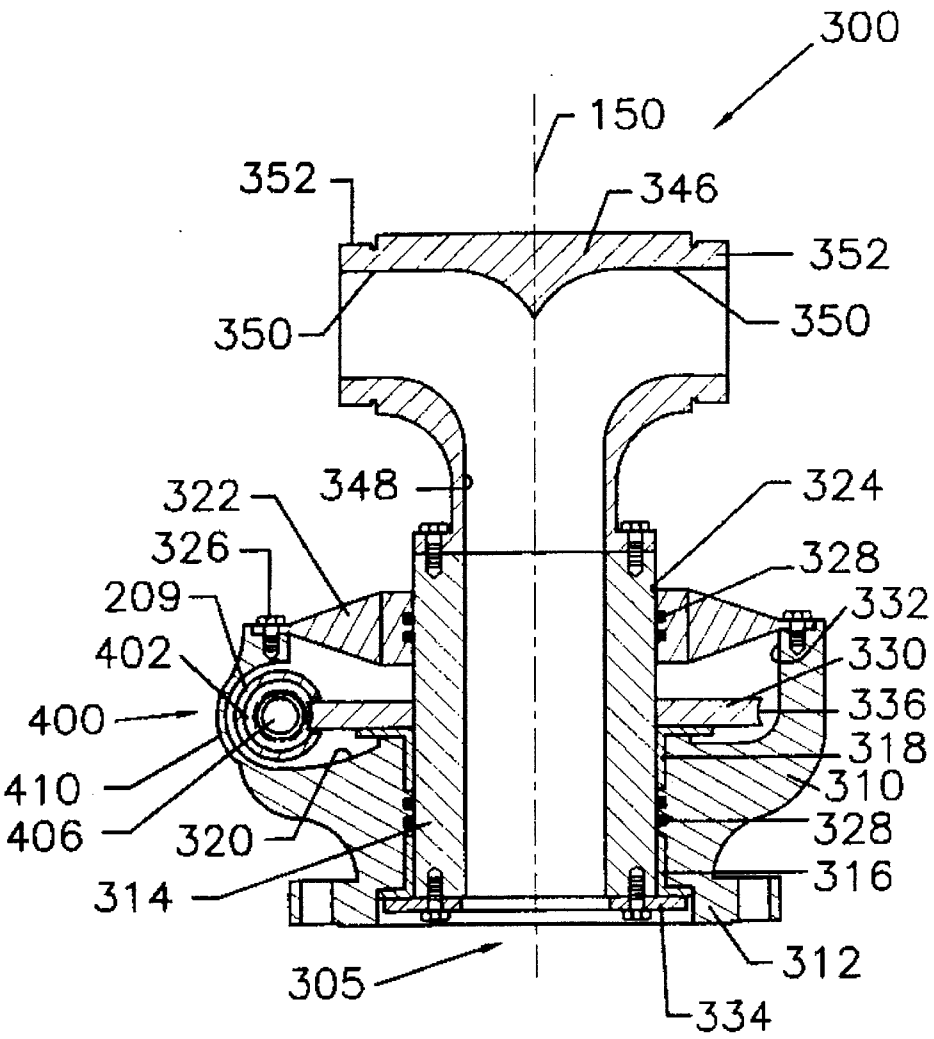
FIG. 2 is a sectional view the apparatus shown in FIG. 1, showing details of a liquid circulator and a worm gear assembly taken along the line 2—2 of FIG. 8 with nozzles removed in the interest of greater clarity.

An apparatus for carrying out the method embodying the present invention, includes a liquid circulator 300 which, when in operation, is positioned inside a liquid storage tank, particularly a crude oil or petrochemical storage tank. The liquid circulator 300 generally comprises a rotatable nozzle support member 346 with one or more nozzles 360 attached to the support member. The liquid circulator further comprises a hollow rotor 314 through which a liquid, such as crude oil, will flow under pressure from an intake conduit 101 to the nozzle support member 346, and discharged through the nozzles 360 into interior of the tank, to cause sludge to be broken into smaller particles.

The crude oil circulator 300 also comprises appropriate means for rotating the nozzles 360. The rotation means generally includes a flat spur gear 330 attached to the hollow rotor 314. When engaged by a driven worm gear 402, the spur gear 330 will rotate the hollow rotor 314, the nozzle support member 346 mounted on the rotor, and the nozzles 360 about a vertical axis 150.

Also, the apparatus for carrying out the method embodying the present invention, has an elongate tubular casing 200 extends from a housing 310, in which the rotor 314 is rotatably supported, and has an outer diameter substantially equivalent to that of an opening 106 in the wall 102 of the storage tank. The tubular casing 200 is provided with flanges so that it can be secured to a gate valve 110 disposed externally of the tank.

A retrievable drive housing 209 is constructed so that it can be slidably inserted into, and withdrawn from, the elongate tubular casing 200. The drive housing 209 is adapted to rotatably support a worm gear assembly 400, a worm gear assembly drive shaft 406, and an attached drive shaft 405 through an open end of the housing.

The liquid circulator 300 is typically connected to a circulation system having a filter system, pumping means and piping or tubing means for providing for circulation of a liquid such as crude oil from the storage tank through a discharge line, through the filter system to the pump, and then discharged through the liquid circulator 300 back into the tank. More specifically, in this mode of operation, the stored liquid is continuously recirculated as a result of withdrawal of liquid from the tank and then returning the withdrawn fluid, under pressure, by way of an intake conduit 101, the hollow rotor 314 and the nozzle support member 346, and then through the nozzles 360 to the interior of the tank. Alternatively, the source of the pressurized liquid delivered to the tank may be a side stream, or a portion, of the liquid added to the tank during filling.

The pump mentioned above is generally a high pressure pump capable of delivering up to about 5,000 gallons per minute of liquid at a pressure of up to about 150 pounds per square inch, and is generally provided with appropriate filter means, such as a pair of filters, mounted in parallel in filter tanks adjacent the storage tank. The filter means is fluidly interconnected with the discharge line of the tank by appropriate conduit means, and the discharge end of the filter means is interconnected with the suction side of the high pressure pump by a conduit. The discharge side of the high pressure pump is connected with the crude oil circulator 300 by the intake conduit 101.

Therefor, in the normal operational mode, the high pressure pump will withdraw fluid, such as crude oil, from the storage tank, through the filter, and then to the high pressure pump. The pump preferably pressures the crude oil to a pressure of about 100 to about 150 psig at a flow rate of from about 4,000 to about 5,000 gallons per minute of crude oil through the nozzles 360 of the circulator 300. The initial velocity of the crude oil ejected from the liquid circulator nozzles 360 is preferably from about 75 to about 120 feet per second, thereby assuring that the velocity of the crude oil will have a velocity of about 0.5 to 2 feet per second adjacent the periphery of the crude oil storage tank.

With this construction, and the above described parameters, crude oil ejected from the nozzles 360 will form an expanding cone of turbulent crude oil. Because of its high velocity, the ejected crude oil will impact with hydrocarbon sludge in the storage tank and cause the sludge to be progressively broken into smaller particles, both physically and as a result of disrupting the molecular charge transfer forces interconnecting the asphaltic, naphthenic, polyaromatic, etc., molecular components of the sludge. As a consequence, the sludge will be progressively dispersed in the crude oil and will be of a size that will normally pass through the filters of the filter means. At the end of the dispersing operation, the aromatic, asphaltenic, naphthenic and/or porphyritic components of the sludge will be molecularly redispersed in the crude oil and comprise a part of the crude oil withdrawn from the storage tank for processing in a refinery normally within which the crude oil storage tank is located.

In the operation of the system as described above, sooner or later the teeth of the worm gear 402 will become stripped, either through normal wear and tear or through the impingement of the nozzles 360 against a physical barrier. At that point, the drive shaft 406, the worm gear assembly 400 and the drive housing 209 are easily withdrawn from the tank. As these components clear the gate valve 110, the gate valve is closed to prevent any accidental leakage of crude oil from the tank through the elongate tubular casing 200. The worm gear 402, or the entire worm gear assembly 400, may be either repaired or replaced. The replacement worm gear or assembly is then reinserted into the elongate tubular casing 200 and into the storage tank by opening the gate valve 110.

Referring now to FIGS. 1, 2, 3 and 8, the crude oil circulator, designated generally by the number 300, is positioned generally at the bottom and center of a crude oil tank of which the tank wall 102 represents one portion of the peripheral wall of the tank. In the preferred embodiment of the present invention, the crude oil circulator 300 includes a housing 310 having a ranged base 312 that mates with a flange 105 attached to the intake conduit 101. The housing 310 is removably connected with the intake conduit 101 by a plurality of bolts extending through aligned holes provided in both of the flanges 105,312.

The circulator 300 also includes the hollow cylindrical rotor 314 that is rotatably supported by the housing 310. A pair of L-shaped bearing pads 316,318, interposed the rotor 314 and an internal bore 320 of the housing 310 provide, after assembly as described below in more detail, both radial and axial support for the rotor 314. The rotor 314 is further supported at its upper end by a centrally disposed internal bore 324 of a guide flange 322. The guide flange 322 is removably attached to the housing 310 by a plurality of cap screws 326. A plurality of radial seals 328 are disposed in the respective internal bores 320,324 of the housing 310 and the guide flange 322 to provide a fluid seal around the outer circumferential surface of the cylindrical rotor 314. The seals 328 prevent leakage of oil, or other fluid stored in the storage tank, into the internal cavity 332 and the interconnected interior of the casing 200.

The spur gear 330 is fixed, preferably by welding, to the outer circumferential surface of the hollow rotor 314 in concentric relationship with the rotor and the axis of rotation 150. The spur gear 330 extends radially outwardly from the rotor 314 into an internal cavity 332 defined by the upper wall surfaces of the housing 310 and the lower wall surfaces of the guide flange 322.

A ring-shaped rotor support plate 334 is attached to the lower end of the housing 310 by a plurality of cap screws, and has a central opening radially aligned with the internal bore surface of the hollow cylindrical rotor 314. The rotor support plate 334 cooperates with a lower planer surface of the spur gear 330, and the radially outwardly extending portions of the bearing pads 316,318 that are respectively interposed the housing 310 and adjacent surfaces of the support plate and gear, to maintain the rotor 314 and attached spur gear 330 in a predetermined axially aligned relationship with respect to the housing 310.

The circulator 300 also includes a hollow nozzle support member 346 that is removably attached to the upper end of the hollow cylindrical rotor 314 by a plurality of cap screws. The hollow nozzle support has internal wall surfaces 348 defining an internal cavity that, at its lower end, is radially aligned with respect to the internal bore 332 of the hollow rotor 314. The internal wall surfaces 348 of the nozzle support member 346 also extend radially outwardly in the upper portion of the support member and define one or more radial openings 350 in the nozzle support member 346. An externally threaded nozzle mount 352 is formed on an outer surface of the support member 346 in concentrically with each of the radial openings 350. In the preferred embodiment, the nozzle support member 346 has two threaded nozzle mounts 352 that are spaced apart by a radial arc of 180 degrees. However, if desired, the nozzle support member 346 may be configured to have a single or, alternatively, more than two nozzle mounts 352.

A nozzle 360, having internal threads provided at an inlet end of the nozzle is threadably mounted on each of the nozzle mounts 352. Each of the nozzles 360 has a discharge orifice 362 disposed at the outlet end of the nozzle that is preferably lined with a suitable erosion material, such as tungsten carbide. Depending on the application and the desires and specifications of the user, various sizes and shapes of crude oil circulator nozzles 360 may be utilized. While not shown, it is understood that a unitary nozzle support with one or more integrally formed nozzles may also be utilized.

The rotatably mounted rotor 314, the nozzle support member 346 and the nozzles 360, are rotated through 360 degrees around the centerline 150 in response to rotation of the spur gear 330. This complete rotation provides continuous spraying around and throughout the tank to be cleaned. The spur gear 330 is driven by a worm gear drive assembly shown generally at 400. More specifically, the drive assembly 400 includes the worm drive gear 402 which mates with a plurality of teeth 336 formed on the periphery of the spur gear 330. As described above, the worm gear 402 is driven by the drive shaft 406.

The worm gear assembly 400 is partially enclosed, and removably supported, by a worm gear assembly housing 410 provided at one side of the circulator housing 310. In the preferred embodiment of the present invention, the worm gear assembly housing 410 is integrally formed, i.e., comprises a single cast member, with the circulator housing 310. Alternatively, the assembly housing 410 :may be a separate fabricated part that is permanently affixed to the circulator housing 310 by a weldment to form a sealed joint between the two components. The worm gear assembly housing 410 and the casing 200 are joined to each other by a housing flange 455 and a casing flange 255 that are interconnected by a pair of nuts 456,256 and a threaded bolt 257.

Referring now to FIGS. 2 and 4–9, the worm gear assembly 400 includes the aforementioned retrievable drive housing 209 which has an elongated slot 403 formed through a portion of the side wall at the forward end of the housing, and the worm gear drive shaft 406 rotatably supported in the drive housing 209 by a pair of bearing assemblies 430,431. Preferably, the retrievable drive housing 209 is formed of multiple sections that are screwed together to form a desired overall length of housing, and for ease of assembly and disassembly. Also, the sectioned construction enables the forward end of the housing to be machined as a separate component, thereby enabling the drive housing 209 to be more easily manufactured.

Figure 9:
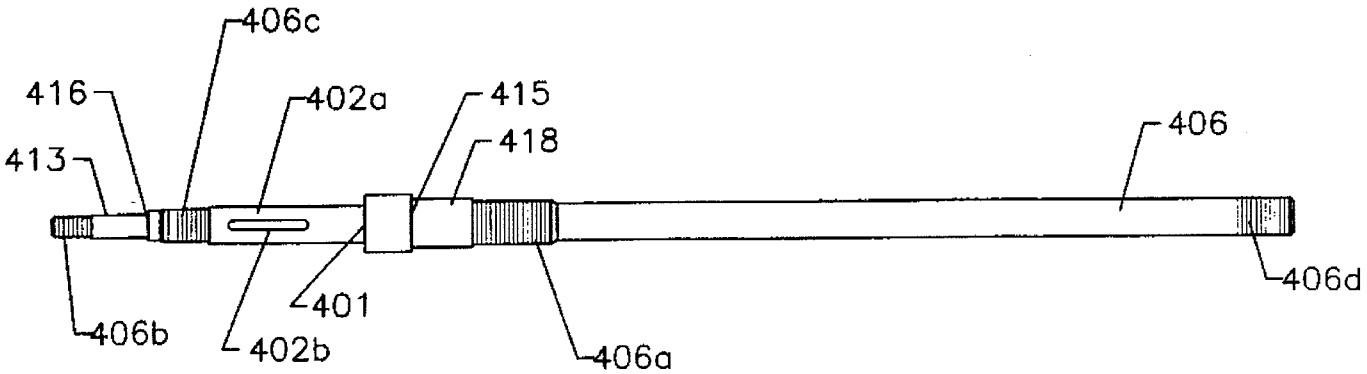
FIG. 9 is a view of the drive shaft removed from the worm gear assembly, showing various elements of the drive shaft.

The worm gear assembly drive shaft 406, best shown in FIG. 9, has a pair of bearing journals 413,418, a pair of bearing abutment shoulders 416,415 respectively associated with the journals 413,418, a centrally disposed worm gear journal **402*a* with a keyway 402*b* provided therein and an associated worm gear abutment shoulder 401, and a plurality of threads 406*a*,406*b*,406*c*,406*d* positioned at axially spaced predetermined positions on the drive shaft 406. As shown assembled in FIG. 4, a pair of retaining nuts 433 on the threads 406*b* cooperate with the forward bearing abutment shoulder 416 to retain the bearing assembly 430 on the forward bearing journal 413. Likewise, a second pair of retaining nuts 438 on the threads 406*a* cooperate with the rearward bearing abutment shoulder 415 to retain the rear bearing assembly 431 on the rear bearing journal 418. In similar fashion, the worm gear 402 is retained in a fixed axial relationship with the shaft 406 by a pair of retaining nuts 435 on the threads 406*c* which cooperate with the worm gear abutment shoulder 401** to prevent axial movement of the worm gear on the shaft.

The forwardly disposed bearing assembly 430 is maintained at a fixed axial position with respect to the drive housing 209 by a snap ring 429 that engages a groove in the wall of the housing 209 to prevent forward movement of the bearing assembly 430 and by a radially inwardly extending shoulder 427 in the wall of the housing which prevents rearward movement of the bearing assembly 430 with respect to the housing 209. The rear bearing assembly 431 is restrained from forward movement with respect to the drive housing 209 by a second inwardly extending shoulder 428 formed in the wall of the housing 209. Thus it can be seen that, after assembly, the worm gear 402 is maintained in a fixed predetermined relationship with respect to both the drive housing 209 and the worm gear assembly drive shaft 406.

The threads **406*d* disposed at the rearward end of the warm gear assembly drive shaft 406 couple the worm gear assembly drive shaft 406 to a drive shaft 405 through employment of a threaded shaft coupling 222. Similar couplings are also used to advantageously connect shaft segments together and provide a desired overall length for the drive shaft 405**.

The worm gear 402 is maintained in a fixed rotational relationship with the drive shaft 406 by a worm gear key inserted into the keyway **402*b*. Preferably the apparatus of the present invention is designed to fail at the worm gear key or by stripping the teeth of the worm gear 402. As described below in additional detail, the worm gear assembly 400 may be removed and serviced much easier than could the circulator 300. Therefore, the worm gear 402 is intentionally formed from a material that is softer than the material of the teeth 336 on the spur gear 330. Preferably, the worm gear 402** is formed of a soft metal such as brass or the like.

As best shown in FIGS. 2 and 5–7, the elongated groove or slot 403 provided in the wall of the forward end of the drive housing 209 allows engagement of the worm gear 402 with the spur gear 330. A worm gear assembly positioning member 420 is attached to the forward end of the retrievable drive housing 209 by a plurality of bolts 421. As best shown in FIG. 1, the worm gear assembly 400 is maintained at a predetermined fixed position with respect to the spur gear 330 by engagement of the worm gear positioning member 420 in a worm gear assembly docking station 450 that is provided in the worm gear assembly housing 410. The docking station, or end cap, 450 has a seat that is contoured to receive a mating end portion of the member 420. The worm gear assembly 400 is held against the docking station 450 by the drive housing 209 which, when coupled with a restraining flange to be described later, maintains the worm gear 402 in engaging alignment with the spur gear 330.

The worm gear assembly 400 is easily removed, by simply pulling the retrievable drive housing 209, containing the shaft 405, the attached shaft 406 and the worm gear assembly 400, from the protective tubular casing 200. As the worm gear assembly clears the gate valve 110, a valve plate 116 is desirably lowered by rotation of a turning bar 118 to preclude accidental or inadvertent leakage of fluid past the seals 328 and then subsequently through the casing 200.

Figure 3:
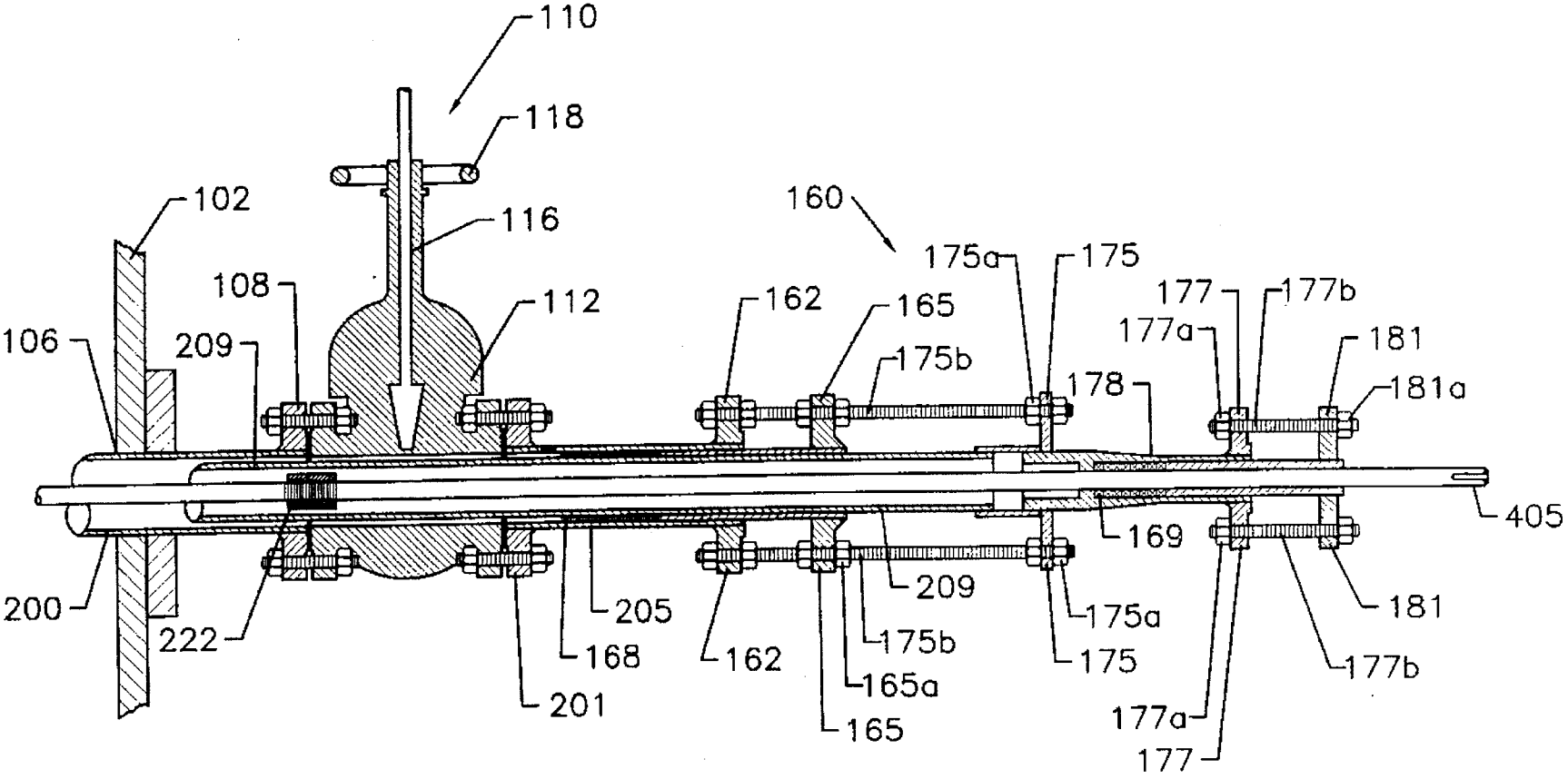
FIG. 3 is an enlarged view from FIG. 1 of a gate valve assembly and the drive shaft.
Figure 5:
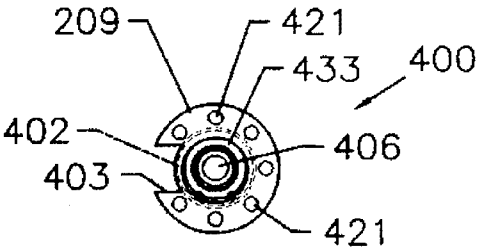
FIG. 5 is a cross-sectional view of the worm gear assembly take along the line 5—5 in FIG. 4.
Figure 7:
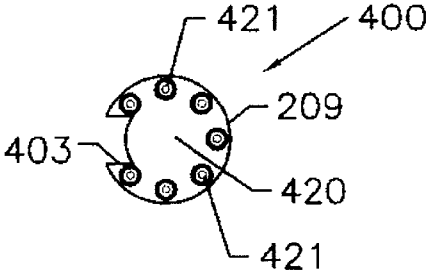
FIG. 7 is an end view of the worm gear assembly.
Figure 4:
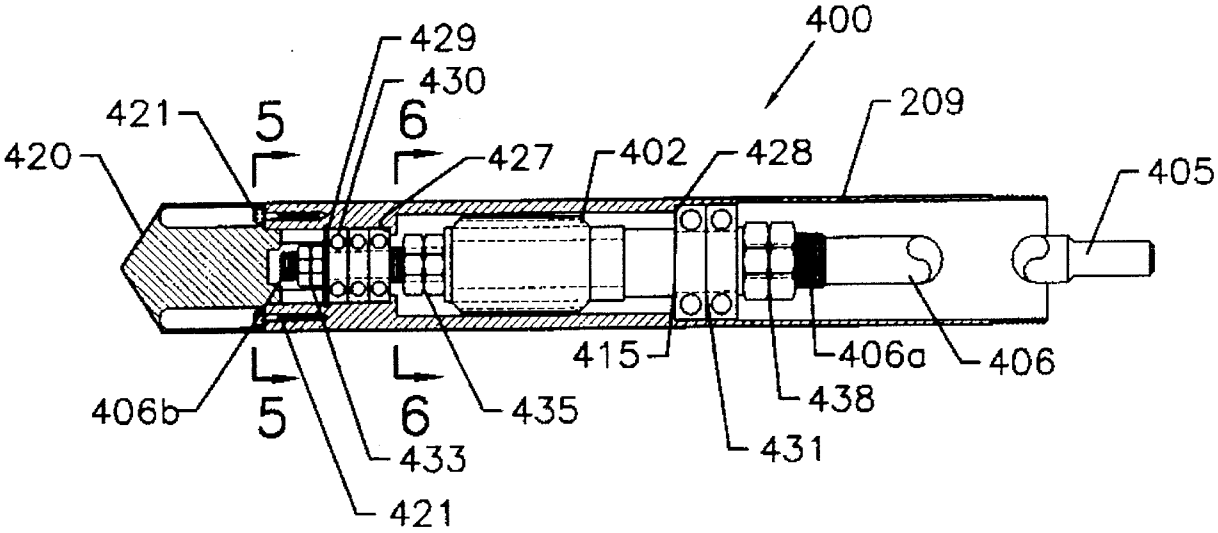
FIG. 4 is an enlarged detail view of the worm gear assembly shown in FIG. 1.
Figure 6:
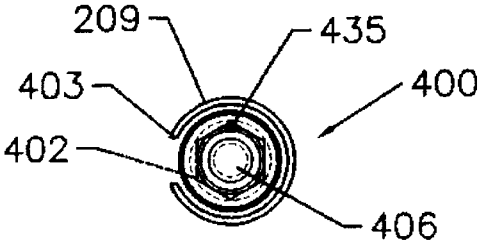
FIG. 6 is a cross-sectional view of the worm gear assembly taken along the line 6—6 in FIG. 4.
Figure 8:
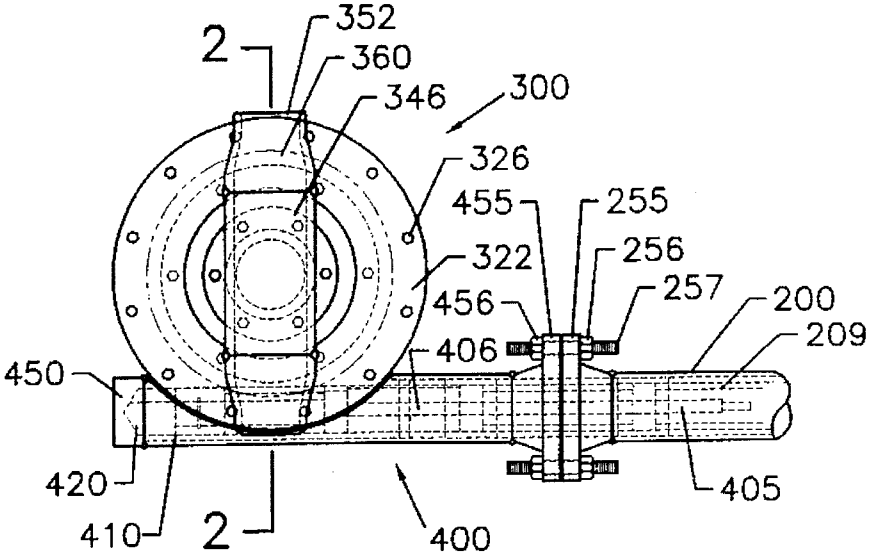
FIG. 8 is a top view of the crude oil circulator and the worm gear assembly, with the crude oil circulator rotated 90 degrees from the position shown in FIG. 1.

As best shown in FIG. 3, the gate valve 110 is connected, at one side of the valve, to a flange 108 mounted on an end of the tubular casing 200 that extends externally of the tank wall 102, and at the other side to a flange 201 attached to one end of a first packing box 205. The packing box 205 contains a packing element 168 interposed an internal wall of the box and the external wall of the retrievable drive housing 209 to provide a seal between the two surfaces.

The tubular casing 200 extends from the gate valve 110 externally of the tank opening 106 to the worm gear assembly 400. The casing 200 serves as a guide and means through which the retrievable drive housing 209 containing the worm gear assembly 400 is moved from an operational position, to servicing and back. The retrievable drive housing 209, is adjustably maintained at a predetermined fixed position with respect to the tubular casing 200, and also with respect to the worm gear assembly housing 410 to which the casing 200 is connected, by adjustment of a drive housing restraining flange 175 attached to the outer end of the drive housing 209. The drive housing restraining flange 175 is adjustably connected to the first packing section 160 by a plurality of nuts 175*a* threadably mounted on the bolts 175*b* that extend through both the drive housing restraining flange 175 and the flange 162 attached to the rearward portion of the first packing section 160. A plurality of shaft guides 221 keep the drive shaft 405 correctly centered within the drive housing 209. As shown in FIG. 1, a drain pipe 224 communicating with the interior of the tubular casing 200 has a valve 225 therewith for the drainage of any liquid that may inadvertently find its way into the casing 200.

In addition to the first packing box 205, a packing section shown generally at 160 includes a first packing pusher 165 that has a radial flange attached to a circular collar adapted to slidably fit between an internal wall surface of the packing box 205 and the external wall surface of the drive housing 209. The first packing pusher 165 is adjustably interconnected to the packing box 205 at the flange 162 by a plurality of interconnecting nuts 165*a* and bolts 175*b*. As can be seen from a study of FIG. 3, the packing 168 is axially compressed when the first packing pusher 165 is moved, by appropriate adjustment of the adjusting nuts disposed on the bolt 175*b*, towards the flange 162.

The packing section 160 also includes a second packing box 178 having internally disposed rope packing 169 to provide a seal around the drive shaft 405. The second packing box 178 is fixedly attached at its forward end to the drive housing restraining flange 175 and has a radial flange 177 attached at its rearward end. Finally, a second packing pusher 181 having a radial flange at the rear thereof, is adjustably connected to the second packing box 178 by a plurality of nuts 177*a*,181*a* threadably mounted on a plurality of bolts 177*b* extending through the rearwardly disposed flange 177 of the packing box 178 and the pusher flange.

The gate valve 110 may be of any desired construction and may comprise, for example, a bonnet 112 and the valve plate 116 which may be raised and lowered by appropriate turning means such as the aforementioned turning bar 118.

The motor unit 500 provides the source of rotational motion needed to rotate the nozzles 360 around the centerline 150. A motor output shaft 505 of the motor unit 500 is linked to the drive shaft 405 by a coupling 502. As the motor unit 505 drives the output shaft 505, the worm gear 402 is also rotated, thereby rotating the spur gear 330, which in turn rotates the cylindrical rotor 314, the nozzle support member 346 and, consequently, the nozzles 360 about the centerline 150.

The speed of the motor unit 500 is controlled such that the outlet nozzles 360 are rotated at a rate of about 0.5 to about 4 revolutions per hour. Thus, the rotational speed of the outlet nozzles 360 is determined by the rotational drive speed of the output shaft 505, the gear ratio of the worm gear 402, and the diameter and tooth pitch of the spur gear 330. Preferably, the motor unit 500 has a controllably variable speed and, desirably, also includes suitable gear box means to provide a reduced motor output shaft speed.

In carrying out the method embodying the present invention, a crude oil storage tank containing crude oil, after a period of operation, has a significant quantity of accumulated hydrocarbon sludge in the bottom, and has a crude oil circulator 300 embodying the present invention positioned in the tank, requires removal of the sludge, a high pressure pump is activated to withdraw crude oil from the tank. The withdrawn crude oil passes through a conduit to the filter system to remove solid particles, through another conduit to the intake of a high pressure pump, and is then discharged from the pump through the conduit 101 to the circulator 300 where it is discharged back into the tank through the nozzles 360.

Alternatively, crude oil may be provided externally of the tank, such as during initial filling of the tank. In this operational mode, the crude oil directed to the tank through the circulator 300 is diverted, as a side stream, from the primary flow of oil into the tank.

At the same time as the crude oil is being circulated, the motor unit 500 independently drives the worm gear 402 through the drive shaft 405. Rotation of the worm gear 402 causes corresponding rotation of the hollow rotor 314 and, consequently, rotation of the nozzles 360, thus distributing a high velocity jet of crude oil around a 360 degree path in the storage tank. As discussed above, the gear ratios in a gear box at the motor unit 500 are selected such that the nozzle support 346 completes about 0.5 to 4 revolutions per hour.

As mentioned earlier, the hydrocarbon sludge or "black sediment and water" that accumulates with time in a crude oil storage tank is formed by the reversible interaction of asphaltenes, porphyrins, condensed ring aromatics, etc., in the crude oil. Thus, the charge transfer forces at the molecular level causes a reversible coupling of these molecular components to form molecules of such a size that they become solid particles big enough to settle as sludge in the storage tank.

However, when the hydrocarbon sludge is impacted with the high velocity jet of crude oil emanating from the nozzles 360, the energy of the ejected crude oil is sufficient to disrupt the charge transfer forces and refragment the hydrocarbon sludge molecules into smaller components that are small enough to be colloidally suspended in or dissolved in the crude oil. Agglomerations of water in the hydrocarbon sludge likewise tend to be atomized and colloidally suspended in a like manner.

The slow rotation of the nozzled outlet jets 360 provides adequate time for the disruption of the charge transfer forces so that the slow rate of rotation actually enhances, rather than impedes the rate at which the hydrocarbon sludge is fragmentized and resuspended in the crude oil.

Normally, with the apparatus of the present invention, a crude oil storage tank can be cleaned in a short time such as a matter of 0.5 to 5 days.

Importantly, the worm gear 402 is designed such that failure of the system, as for example the result of accidental impingement of rotating elements of the circulator 300 against a fixed barrier, will cause failure at the worm gear 402, either by stripping of the teeth on the worm gear 402, or by breaking the key that secures the worm gear 402 in place on the shaft 406.

Once failure occurs, repairs to the system can be made very easily. The motor unit 500 and the drive shaft 405 are uncoupled at the coupling 502. The worm gear drive housing 209 can be withdrawn by removing the nuts 175*a* from the bolts 175*b*, connecting the drive housing restraining flange 175 to the packing box 205, and then pulling the drive housing 209 from the casing 200. After the forward end of the drive housing 209 clears the gate valve 110, the valve is preferably closed during the following service procedure to prevent any accidental leakage of fluid past the seals 328 and subsequently through the casing 200.

After withdrawal of the drive housing 209 from the casing 200, the worm gear assembly 400 is serviced to repair or replace the sheared key or stripped gears. The worm gear assembly 400 is disassembled by first removing the bolts 421 and separating the worm gear positioning member 420 from the forward end of the drive housing 209. After removal of the worm gear positioning member 420, the forward retaining nuts 433 are unscrewed from the end of the worm gear assembly drive shaft 406, after which the shaft 406, along with the remaining shaft-mounted elements of the worm gear assembly 400, is withdrawn from the drive housing 209. After removal of the worm gear retaining nuts 435, the worm gear 402 may be separated from drive shaft 406. If required, the bearing assembly 430 may also be removed for cleaning or replacement at this time by removal of the snap ring 429.

After replacement of the worm gear 402, or the key between the worm gear 402 and the shaft 406, or both, the worm gear is reinstalled on the shaft journal 402*a* and secured thereon by the retaining nuts 435. The forward end retaining nuts 433 are then installed to axially retain the worm gear drive shaft 406 in the desired position with respect to the drive housing 209. The reassembly of the worm gear assembly 400 is then completed by reattaching the worm gear positioning member 420 to the end of the drive housing 209.

After reassembly, the worm gear assembly 400 is then placed into operable engagement with the circulator 300 by insertion through the casing 200. As the forward end of the worm gear drive shaft 209 approaches gate valve 110, the valve plate 116 is raised to allow passage of the shaft into the tank. To provide passage of the forward end of the drive housing 209 past the spur gear 330, the elongated slot 403 at the forward end of the drive housing 209 must be radially aligned with the spur gear 330. The shaft 405, with the worm gear drive shaft 406 with the worm gear 402 mounted thereon, is then rotated simultaneously with moving the drive housing 209 forwardly. This will insure proper engagement of the worm gear 402 with the mating teeth of the spur gear 330 without risking possible stripping or damage to the teeth upon initial contact. Insertion of the drive housing 209 is continued until the positioning member 420 abuts and properly engages the seat provided in the docking station 450. The positioning member 420 is maintained in biased contact with the docking station 450 adjustment of the nuts 175*a* to controllably position the drive housing restraining flange 175.

Other aspects, features and advantages of the present invention can be obtained from a study of this disclosure together with the appended claims.

What is claimed is:

1. A method for redispersing hydrocarbon sludge deposited in a crude oil storage tank having a side and an opening in the side covered by a valve, a crude oil circulator disposed within said tank and having a least one rotatable nozzle and a gear member attached to a hollow rotor supporting the nozzle and rotatably mounted in said circulator, an elongated tube connected to the circulator and extending through the opening in the side of said tank and having a drive shaft and a worm gear driven by said drive shaft and positioned in said tank and in engagement with the gear member, the method comprising the steps of:

(a) circulating the crude oil from the tank to a pump and then through the nozzle at a selected flow rate;

(b) simultaneously rotating the worm gear, the gear member, the hollow rotor and the nozzle at a controllable rate independent of the selected flow rate;

(c) repeating steps (a) and (b) until the worm gear fails, and then;

(d) pulling the shaft driven worm gear through the tube to a point just past the valve;

(e) closing the valve;

(f) removing the shaft driven worm gear from the tube;

(g) repairing the worm gear or other elements of the drive shaft operatively connected to the worm gear;

(h) inserting the worm gear into the tube until it approaches the closed valve;

(i) opening the valve;

(j) inserting the worm gear further into the tube until it engages the gear member attached to the hollow rotor; and (k) repeating step (c).

2. A method for redispersing hydrocarbon sludge, as set forth in claim 1, wherein said circulator has a worm gear assembly docking station disposed within a housing attached to said circulator and said shaft driven worm gear has a positioning member, and said simultaneously rotating the worm gear, the gear member, and the hollow rotor and the nozzle, includes simultaneously maintaining a positioning member in contact with said docking station.

3. A method for replacing a drive train of a circulator for dispersing hydrocarbon sludge deposited in a crude oil storage tank without draining oil from the tank or removing the circulator, comprising:

(a) disengaging a worm gear operatively connected to the drive train from a spur gear rotatably mounted in the circulator rotating said worm gear in a direction counter to a normal operative driving direction;

(b) withdrawing the drive train and the worm gear through an elongated tube extending from the circulator, through an opening in a side of said storage tank, to a position exterior of said tank, said opening having a valve operatively associated therewith and said withdrawing continuing until a distal end of the drive train is withdrawn to a position past the valve;

(c) closing the valve;

(d) removing the drive train and the worm gear from said elongated tube;

(e) repairing or replacing said worm gear;

(f) inserting said drive train with said repaired or replaced worm gear into said elongated tube until the distal end of the drive train approaches the closed valve;

(g) opening the valve;

(h) inserting the drive train further into the elongated tube until said worm gear engages the spur gear rotatably mounted in said circulator.

* * * * *